US005664339A

United States Patent [19]

Swanson et al.

[11] Patent Number: 5,664,339

[45] Date of Patent: Sep. 9, 1997

[54] LINT BASKET FOR A LINT STORAGE SYSTEM

[75] Inventors: Edward T. Swanson; Patrick J. Clark, both of St. Joseph; James J. Visin, Benton Harbor; Robert E. Smith; Johnny W. Zimmerle, both of St. Joseph, all of Mich.

[73] Assignee: Whirlpool Corporation, Benton Harbor, Mich.

[21] Appl. No.: 697,158

[22] Filed: Aug. 21, 1996

Related U.S. Application Data

[63] Continuation-in-part of Ser. No. 425,740, Apr. 20, 1995, Pat. No. 5,560,120.

[51] Int. Cl.[6] ..... F26B 19/00

[52] U.S. Cl. ..... 34/82; 34/595; 55/295

[58] Field of Search ..... 34/82, 85, 595, 34/604; 55/487, 486, 485, 295

[56] References Cited

U.S. PATENT DOCUMENTS

| | | | |
|---|---|---|---|
| 2,752,004 | 6/1956 | Hullar | 183/62 |
| 2,753,952 | 7/1956 | Engel | 183/62 |
| 3,085,348 | 4/1963 | Adey et al. | 34/82 |
| 3,423,906 | 1/1969 | Fried | 55/302 |
| 3,718,982 | 3/1973 | Deaton | 34/82 |
| 3,823,833 | 7/1974 | Cox | 46/4 |
| 4,106,213 | 8/1978 | Witte | 34/79 |
| 4,653,200 | 3/1987 | Werner | 34/82 |
| 4,700,492 | 10/1987 | Werner et al. | 34/32 |
| 5,042,170 | 8/1991 | Hauch et al. | 34/82 |
| 5,067,253 | 11/1991 | Hauch et al. | 34/82 |

*Primary Examiner*—Henry A. Bennett
*Assistant Examiner*—Dinhatia Doster
*Attorney, Agent, or Firm*—Thomas J. Roth; Mark A. Davis

[57] ABSTRACT

A lint enclosure system for a laundry dryer including an elongated lint basket supported beneath a lid. The lint basket is formed from a filter wall having a first end wall and a second end wall disposed at opposite ends. The filter wall has a generally U-shaped cross-section. An inlet opening is formed into the first end wall and a plurality of outlet openings are formed into the filter wall. The outlet openings are configured to cover successively greater portions of the filter wall at successive linear points between the first wall and the second wall. Lint builds up linearly in the lint basket, accumulating in a linear fashion from the second end wall toward the first end wall. The lid positioned above the lint basket includes a window disposed adjacent the first end wall such that when lint accumulation is visible through the window the basket is substantially full of lint. In this fashion, the window operates as visual signaling means for cleaning the lint from the basket.

14 Claims, 4 Drawing Sheets

LINT BASKET FOR A LINT STORAGE SYSTEM

This application is a continuation-in-part of application Ser. No. 08/425,740, filed Apr. 20, 1995 U.S. Pat. No. 5,560,120, commonly assigned with the present invention.

BACKGROUND OF THE INVENTION

1. Field of the Invention

The present invention is related to a household laundry dryer and more specifically to a lint collection basket for a lint handling system of a dryer.

2. Description of the Related Art

One of the most common problems with household laundry dryers is the lint handing system. Most dryers include a removable lint screen through which lint laden air exiting the dryer is directed to pass. This screen acts as a filter and removes the lint from the exiting air to avoid undesirable lint discharge through the dryer exhaust.

Unfortunately, clogging of the lint screen can lead to poor drying performance and dangerous operating conditions. Accordingly, the operator of the dryer must manually remove the lint screen and frequently clean it, in some case after every dryer cycle. This lint screen cleaning task can become tedious and cause inconvenience to the user. As a result, attempts have been made to improve the lint handing system to provide a lint storage system such that the operator of the dryer does not have to frequently remove and clean a lint screen.

For example, U.S. Pat. No. 3,081,555 discloses a lint separator which includes an air swifter to separate lint from the exhaust air flow and a transport tube connected tangentially to the swirler to receive the separated lint and carry it to a disposable lint collection filter bag. Periodically, the lint bag is replaced with a new filter bag. While this system eliminates the need for frequent lint screen cleaning, it has the disadvantage of requiring the purchase of disposable lint storage bags. This system also does not lend itself to a simple visual system for indicating when the lint bag needs to be replaced.

U.S. Pat. No. 2,752,004 discloses a drawer-like screen assembly disposed along the base of a dryer. The screen assembly includes an inclined perforate top wall portion wherein during operation lint laden air flow from a centrifugal blower is directed against the bottom surface of the inclined top wall portion. The lint is therefore swept downward along the inclined perforate top wall portion and compacted in the narrow end of the lint screen assembly. The screen assembly includes a handle and may be withdrawn periodically for cleaning. This system is relatively costly and inconvenient to access. Moreover, relatively high speed air flow must be supplied into the screen assembly in order for the lint to be swept toward the narrow end of the screen assembly. Supplying a high volume of air flow into a lint screen assembly has several disadvantages such as extruding lint through the perforations of the screen.

SUMMARY OF THE INVENTION

It can be seen, therefore, that it would be an improvement in the art to provide a simple lint basket system for collecting and storing lint from the exhaust air of a dryer such that the lint need only be removed from the basket after a relatively large number of dryer loads have been run.

Accordingly, the present invention is directed to a lint basket system which is capable of receiving and storing lint such that the basket does not become quickly clogged. The lint basket is preferably designed for use with a centrifugal type lint separation system such that only lint laden air is directed into the lint basket.

The lint storage system of the present invention includes a lint basket formed from an elongated main body disposed beneath a lid. The main body is formed from a filter wall having a first end wall and a second end wall disposed at opposite end. The filter wall has a generally U-shaped cross section. An inlet opening is formed into the first end wall and a plurality of outlet openings are formed into the U-shaped filter wall. The outlet openings are configured to cover successively greater portions of the filter wall at successive linear points between the first wall and the second wall. In this fashion, lint builds up linearly in the lint basket, accumulating in a linear fashion from the second end wall toward the first end wall. The lid positioned above the lint basket includes a window disposed adjacent the first end wall such that when lint accumulation is visible through the window the basket is substantially full of lint. In this fashion, the window operates as visual signaling means for cleaning the lint from the basket.

FIG. *7a* is a top view of the lint collection basket of the present invention.

FIG. *7b* is a side view of the lint collection basket of the present invention.

DESCRIPTION OF THE PREFERRED EMBODIMENT

Figure 1:
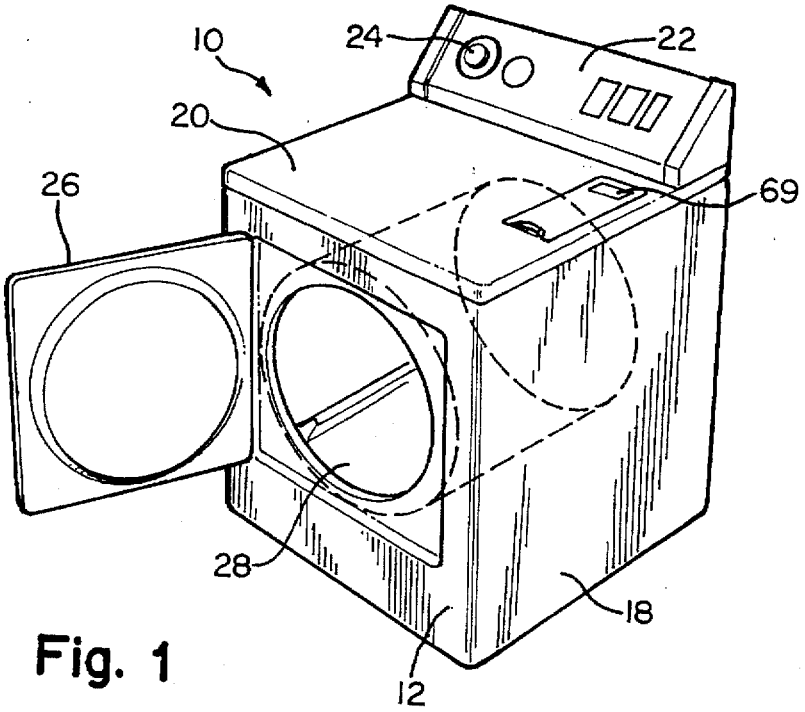
FIG. 1 is a front perspective view of a laundry dryer embodying the lint storage system of the present invention.
Figure 2:
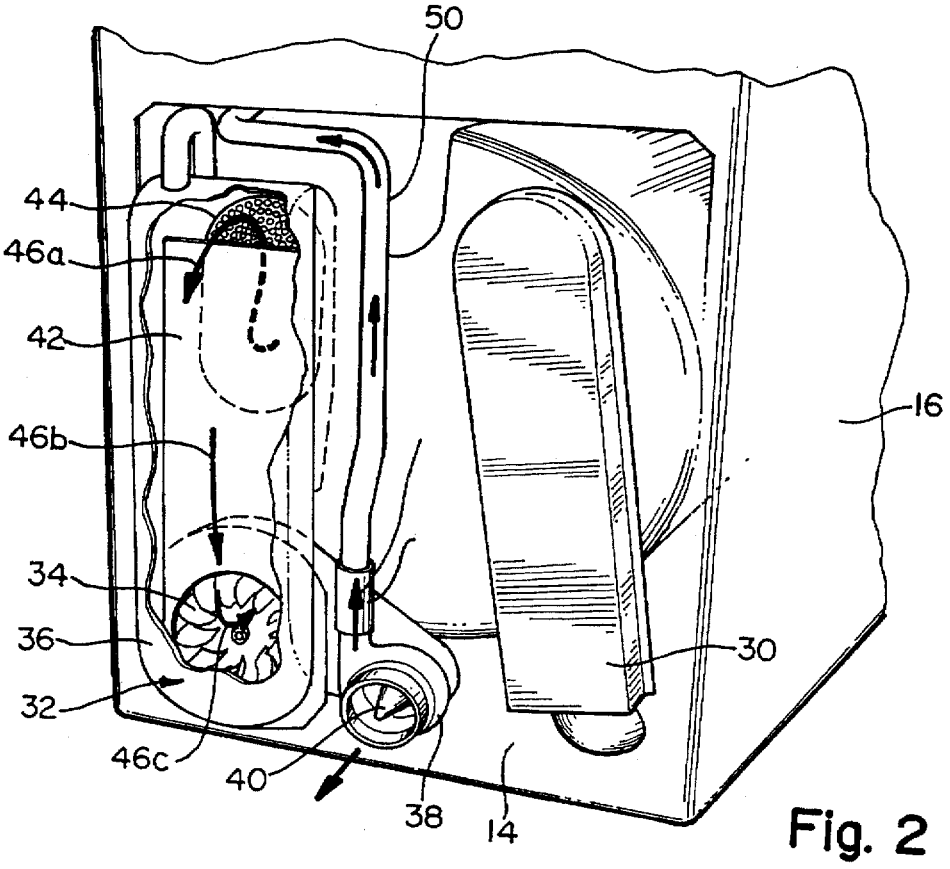
FIG. 2 is a rear perspective view of the laundry dryer of FIG. 1, partially broken away, illustrating additional details of a lint separator and a foreign objects trap in accordance with the principles of the present invention.

FIGS. 1 and 2 generally illustrate a preferred embodiment of the present invention, an improved lint handling system is provided in a household laundry dryer. Such a household laundry dryer is indicated generally at 10 and comprises a cabinet having a front wall 12, a real wall 14 and side walls 16 and 18. A top panel 20 forms a top surface of the cabinet enclosure. Mounted at the rear of the top panel 20 is a control panel 22. Control knobs 24 are provided on the control panel 22 for operating the dryer 10. The dryer 10 also has a door 26 hingedly mounted onto the front wall 12 of the cabinet which provides access into a drum 28 in the interior of the dryer 10.

In greater detail, FIG. 2 illustrates, in a partially cut-away view, the rear wall 14 of the dryer 10. Mounted on the rear wall 14 and communicating with the drum 28 is a heater box 30. The heater box 30 generates heat necessary to dry clothing in the drum 28 of the dryer 10. A blower housing 32 surrounding a blower 34 is located near the bottom of the dryer 10. The blower housing includes a swirl chamber 36 and a lint separator referenced generally at 38. Located within the lint separator 38 is a concentrically disposed diffuser 40. A foreign object trap 42 is also provided, connected to a dryer drum air exit grill 44.

During operation, air external from the dryer is drawn into the dryer drum through the heater box 30. After circulating through the drum, the moist, lint laden air passes though the exit grill 44 into the foreign objects trap 42, as indicated by the air flow arrow 46*a*. The moist, lint laden air continues toward the bottom of the dryer as indicated by flow arrow 46*b* and is drawn into the blower housing 32 as shown by flow arrow 46*c*. The lint laden air is swirled within the blower housing 32 and is directed into the swirl chamber 36.

Figure 3:
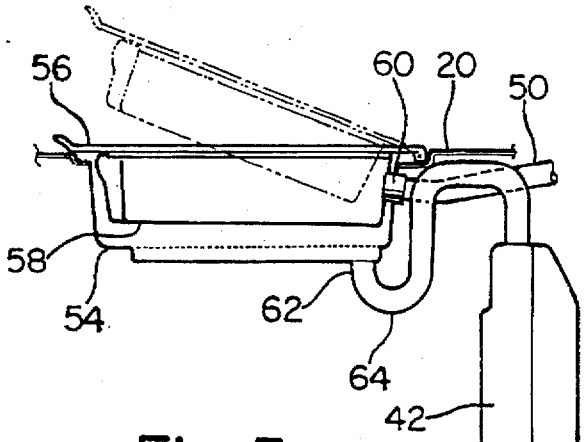
FIG. 3 is a side view of the lint storage system of the present invention.

As the lint laden air swirls within the swirl chamber 36, centrifugal force acts upon the lint, which has more mass than the air, and cause it to separate and move outwardly in the swirling air stream. The relatively lint free air swirling in the inner portion of the swirl chamber 36 is then directed to exit the swirl chamber 36 as indicated by flow arrow 46*d* while the separated lint laden air in the outer portion of the swirl chamber 36 passes through a tangential outlet port 48 and travels through a lint transport tube 50, as shown by arrows 46*d* within the lint transport tube 50, to a lint storage system 52 (FIG. 3) of the present invention. FIG. 3 is a partial side, cut away view which illustrates the basic features of the lint storage system 52 of the present invention. A lint tray 54 is supported by the top panel 20 of the dryer. A lid 56 is hingedly connected to the lint tray 54 and slidingly supports a lint basket 58. The lid 56 can be positioned in a closed position and an open position (shown in dashed lines).

The lint tray 54 includes an air inlet port 60 and an air outlet port 62. The lint transport tube 50 connects to the air inlet port 60 for supplying lint laden air thereto. A recirculation tube 64 has a first end which connects to a fitting extending about the air outlet port 62 and has a second end which connects to the foreign objects trap 42. In this manner, as understood by one skilled in the art, air may circulate through the lint tray 54.

Figure 4:
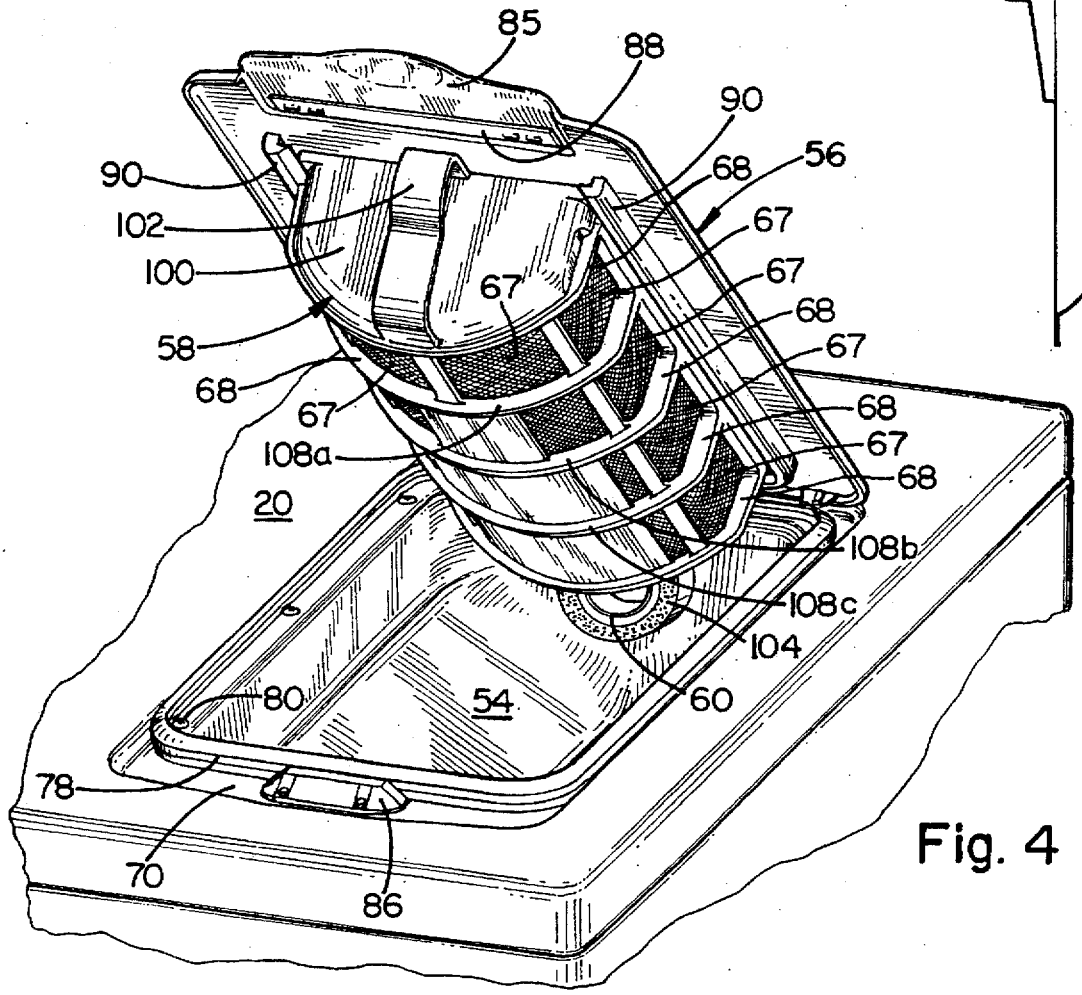
FIG. 4 is a detailed front perspective view of the lint storage system of the present invention with the lid partially open.
Figure 5:
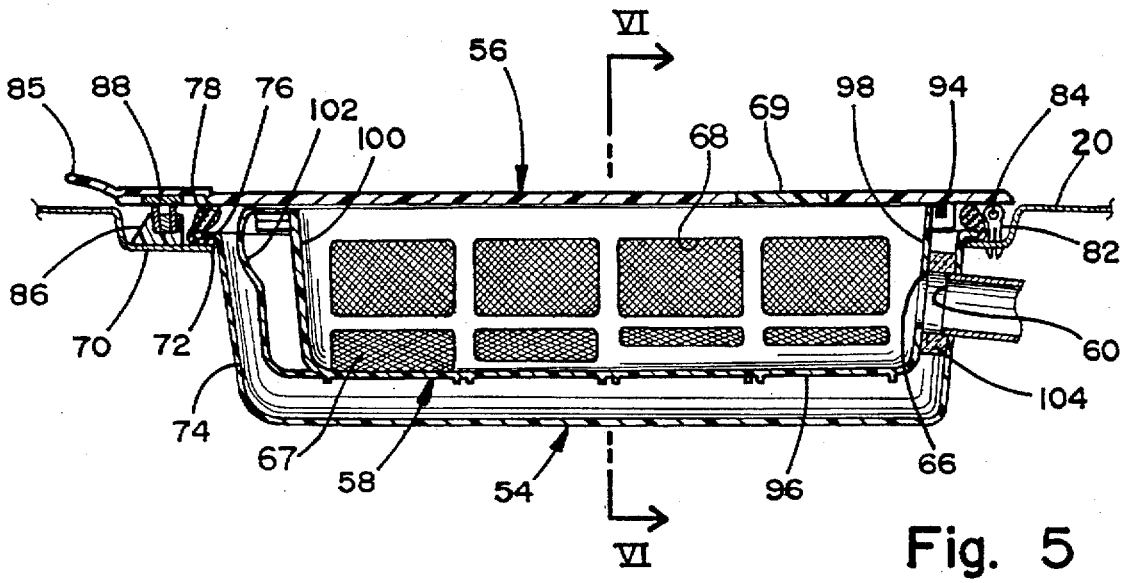
FIG. 5 is a cut-away side view of the lint storage system of the present invention in the closed position.
Figure 6:
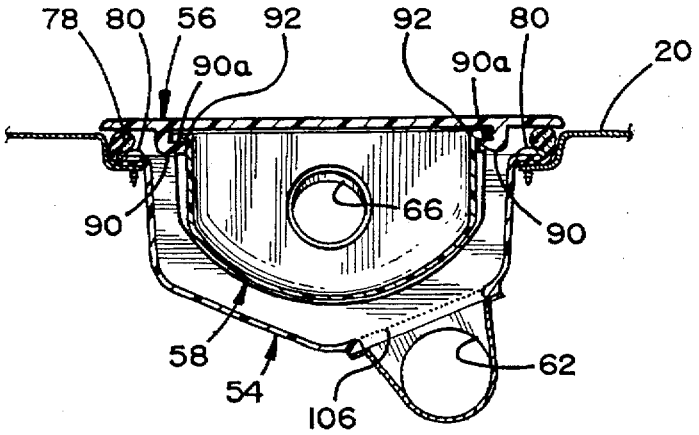
FIG. 6 is a sectional view taken along line 6—6 of FIG. 5.

Turning now to FIGS. 4, 5 and 6, details of the lint storage system of the present invention can be further understood. When the lid 56 is in its closed position, the basket 58 is supported within the tray 54 and includes an inlet opening 66 (FIG. 5) which aligns with the inlet port 60 of the lint tray 54 so that the lint laden air from the lint transport tube 50 is directed into the basket 58. The basket 58 includes a plurality of monofilament screen portions 67 supported over a plurality of outlet openings 68. Air entering the basket 58 exits through the screen portions 67 which filters the lint from the air such that lint is collected in the basket interior during the dryer operation. The lid 56 includes a window 69 (FIG. 1) that provides the user with a visual indication of when the basket 58 is full of lint and needs emptying.

As stated above, the lint tray 54 is supported by the top panel 20. In particular, the top panel 20 includes a drawn down surface portion 70 surrounding a top panel opening 72 such that the drawn down surface 70 forms the peripheral edge of the opening 72. The lint tray 54 includes a main body portion 74 which fits within the opening 72 and further includes a top flange 76 which extends above the drawn down surface 70 of the top panel 20. A resilient, elastomeric gasket 78 is disposed about the top flange 76 and has a portion which is captured between the top flange 76 and the drawn down surface 70. The tray 54 is secured to the top panel 20 by a plurality of threaded fasteners 80.

The lid 56 is hingedly connected to the top panel 20 by hinge members 82 which snap connect to the top panel 20 at one end of the top panel opening 72 and rotatably support hinge pins 84 which extend from the bottom surface of the lid 56. The lid 56 is supported by the hinge members 82 such that in a closed position (FIGS. 5 and 6), the bottom surface of the lid 56 sealingly engages the gasket 78 such that the lid 56 and the lint tray 54 form a sealed enclosure.

This sealing engagement between the lid 56 and the tray 54 is enhanced by creating a closure force for urging the lid closed. The closure force is generated by a magnet assembly 86 (FIG. 4) which is attached to the drawn down surface 70 of the top panel 20 at the end of the top panel opening opposite the hinge members 82. The magnet assembly 86 is positioned to attract a steel plate 88 which is connected to the bottom surface of the lid 56. In this manner, the lid 56 is drawn into the gasket 78 thereby ensuring a sealing engagement between the tray 54 and the lid 56.

As mentioned above, the lid 56 slidingly supports the basket 58. The lid 56 includes a pair of downwardly extending rails 90. The rails 90 include inwardly extending portions having horizontal slide surfaces 90*a* facing the bottom surface of the lid 56. The basket 58 includes side flanges 92 extending outwardly along the top side edges of the basket. The side flanges 92 are received into the gap or slot between the horizontal surface 90*a* and the bottom surface of the lid 56 such that the basket is supported by the lid. A back wall 94 extending from the lid 56 limits travel of the basket 58 along the rails 90. The basket is an elongated body generally having a U-shaped cross section and an open top portion. When the basket 58 is slidingly joined to the lid 56, the lid 56 acts as a lid or top wall of the basket 58 such that the basket forms an enclosure for receiving lint.

As can be readily understood by one skilled in the art, the basket 58 can be removed from and engaged with the lid 56 when the lid 56 is in an open position. A handle 102 extending outwardly from the second end wall 100 of the basket 58 facilitates removal, cleaning and replacement of the basket by the operator. When the lid 56, supporting the basket 58, is rotated from an open position to a dosed position, the basket 58 is rotated down into the cavity formed by the lint tray 54. As the basket 58 is rotated into the lint tray cavity, the first end wall 98 of the basket 58 engages an annular seal member 104 disposed about the air inlet port 60. When the lid 56 is completely closed, the basket 58 is sized such that the handle 102 engages the main body 74 of the tray 54 and moves the end wall 98 into the annular seal 104 such that the seal 104 is compressed.

In this fashion, the tray inlet port 60 and the basket inlet opening are sealingly connected such that lint traveling through the lint transport tube 50 is directed into the enclosure formed by the basket 58 and the lid 56. The air entering the basket enclosure is then forced through the screen portions 67 extending over the basket outlet openings 68 such that the lint is filtered out of the air and captured in the basket 58. The filtered air travels between the outer surface of the basket 58 and the tray 54 and is drawn behind a bottom plate 106 (FIG. 6) of the tray 54 and out through the outlet port 62.

Figure 7A:
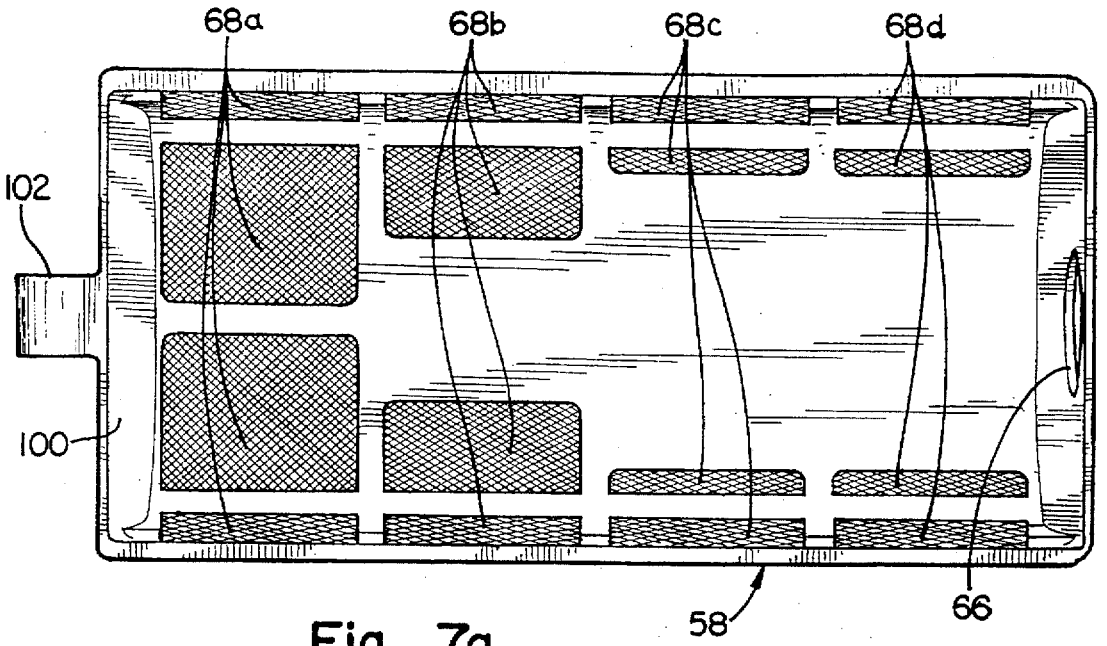
Figure 7B:
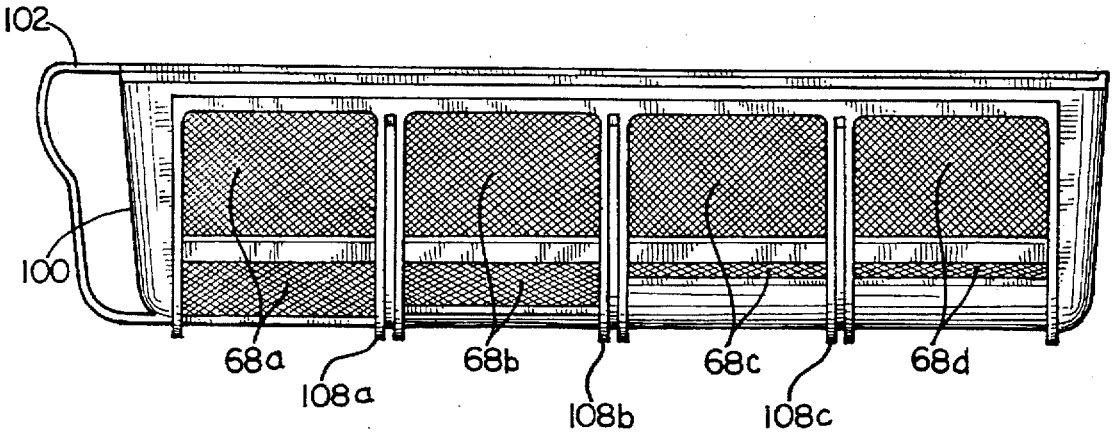

Turning now to FIGS. 7*a* and 7*b*, details of the basket 58 can be clearly seen. The basket comprises a U-shaped filter wall 96, a first end wall 98 and a second end wall 100. The inlet opening 66 is disposed on the first end wall 98 and the outlet openings 68 are disposed along the U-shaped filter wall 96. The U-shaped filter wall 96 of the basket 56 is divided into four equal portions by support ribs 108*a*, 108*b* and 108*c*. The screened outlet openings 68 are provided between the end walls 98 and 100 and the ribs 108*a*, 108*b*, 108*c* and 108*d*. More particularly, the outlet openings are oriented and sized such that outlet openings 68*a* cover substantially the entire surface area between the second end wall 100 and the support rib 108*a*. Between ribs 108*a* and 108*b*, outlet openings 68*b* cover less surface area then outlet openings 68*a*. Finally, between ribs 108*b* and 108*c* and between rib 108*c* and the first end wall 98, outlet openings 68*c* and 68*d* cover less surface area than covered by outlet openings 68*b*.

In this fashion, between the first end wall 98 and the second end wall 100 successively greater portions of the surface area of the U-shaped filter wall of the basket 58 are covered by the outlet openings 68*a*, 68*b*, 68*c* and 68*d*. Accordingly, a greater quantity of air introduced into the basket 58 flows through the openings 68*a* than through 68*b*. Likewise, a greater quantity of air is filtered through openings 68*b* than through 68*c* or 68*d*. This configuration of the screened outlet openings 68 results in proportioning the air flow out of the basket such that a majority of the air exits through the outlet openings 68*a* and 68*b* near the second end wall 100. Although the outlet openings 68*a*–68*d* are illustrated as being reduced in a stepped fashion, any type of reduction, including a continuous reduction, is suitable. The rate of the reduction will vary depending on the size and shape of the basket 58 and the air flow rate.

By proportioning the air flow through the basket in this manner, a greater amount of lint is filtered near the second end wall 100 than near the first end wall 98. This results in a lint accumulation within the basket 58 in a linear fashion such that the lint builds up near the second end wall 100 first and then grows toward the first end wall 98 during successive dryer operations. This linear lint collection results in a lint "loaf" forming in the basket. The lint basket 58 is supported by the lid 56 such that the window 69 is disposed over the lint basket near the first end wall 98. Accordingly, when the lint loaf is visible to the operator through window 69, the lint basket 58 is substantially full of lint. In this manner, the entire capacity of the basket 58 is utilized before an indication or signal is made to the operator to clean the lint basket resulting in an optimum cleaning frequency of the lint basket.

In operation, as the dryer is run, the lint is separated and directed into the basket 58 where it is deposited or collected in a linear fashion corresponding to the size of the openings 68*a*–68*d*. In other words, most of the lint initially collects beginning at end wall 100 and moves towards the wall with the inlet opening 66. When the lint has collected to the size where the leading edge of the loaf is visible in the window 69, the user can visually see that it is time to clean the basket 58.

It can be seen, therefore, that the present invention provides a unique and advantageous configuration of a lint basket which results in optimal collection and storage of lint. Although the present invention has been described with reference to a specific embodiment, those of skill in the Art will recognize that changes may be made thereto without departing from the scope and spirit of the invention as set forth in the appended claims.

We claim:

1. A lint basket for a lint storage system for a laundry dryer, the lint basket comprising:

an elongated main body having a first end and a second end and further having:

an inlet opening at the first end, and an outlet opening which extends longitudinally along the main body and is configured to have increased size at successive linear points extending from the first end to the second end; and a filter medium disposed across the outlet opening.

2. The lint basket according to claim 1, wherein the filter medium comprises a monofilament screen which facilitates lint removal.

3. The lint basket according to claim 1, wherein the main body further comprises:

a filter wall having a U-shaped cross section;

a first end wall at the first end; and a second end wall at the second end.

4. The lint basket according to claim 3, wherein the outlet opening comprises:

a plurality of openings formed into the U-shaped filter wall wherein the openings are configured to cover successively greater portions of the filter wall at successive linear points between the first end wall and the second end wall.

5. The lint basket according claim 1 further comprising:

a handle portion extending from the main body.

6. The lint basket according to claim 1, the main body further comprises:

a first end wall;

a second end wall a U-shaped filter wall extending between the first and second end walls, the U-shaped filter wall generally having a bottom wall and upwardly extending side walls;

a plurality of screened side wall openings provided in the side walls extending from the first end wall to the second end wall; and a plurality of screened bottom wall openings provided in the bottom wall wherein the screened bottom wall openings cover substantially the entire bottom wall area near the second end wall and cover only a small portion of the bottom wall area near the first wall.

7. The lint basket according to claim 1, the main body further comprises:

a first end wall;

a second end wall a U-shaped filter wall extending between the first and second end walls, the U-shaped filter wall generally having a bottom wall and upwardly extending side walls having flanges located along the top edge;

a plurality of U-shaped ribs disposed along the U-shaped filter wall perpendicular to the longitudinal axis of the main body wherein the U-shaped ribs divide the U-shaped filter wall into a plurality of U-shaped sections; and a plurality of screened openings formed in the U-shaped sections wherein substantially the entire area of the U-shaped section adjacent the second wall is covered by screened openings and approximately half of the area of the U-shaped section adjacent the first wall is covered by screened openings.

8. The lint basket according to claim 1, further comprising:

an indicator for visually signaling when the lint basket is substantially full of lint.

9. A lint storage enclosure system for a laundry dryer, the lint storage enclosure system comprising:

an elongated lint basket having an inlet opening for receiving lint laden air;

means for creating a linear collection of lint within said elongated main body; and an indicator for visually signaling when the lint basket is substantially full of lint.

10. A lint storage system for a laundry dryer comprising:

an elongated lint basket having:

a first end wall having an inlet opening, a second end wall, a filter wall extending between the first and second end walls, the filter wall generally having a U-shaped cross-section and further having an outlet opening extending longitudinally from the first end wall to the second end wall wherein the outlet opening is configured to have increased size at successive linear points extending from the first end wall to the second end wall;

a filter medium disposed across the outlet opening; and a lid disposed above the lint basket having a window disposed near the first end wall of the lint basket, wherein lint is supplied into the lint basket through the inlet opening and accumulates in linear fashion therein growing from the second wall to the first wall such that when lint accumulation is visible through the window the lint basket is substantially full of lint.

11. The lint basket according to claim 10, further comprising:

a plurality of outlet openings in the filter wall wherein the outlet openings are configured to cover successively greater portions of the filter wall at successive linear points between the first wall and the second wall.

12. The lint storage system according to claim 10, wherein the filter wall further comprises a bottom wall portion and side wall portions extending from the opposite sides of the bottom wall portion, each side wall having a top edge portion having a flange wherein the bottom wall portion and side wall portions form a U-shaped cross-section.

13. The lint storage system according to claim 12, further wherein the lid has a pair of support rails for slidingly receiving the flanges of the filter wall such that the lid slidingly supports the lint basket and forms a top surface of the lint basket such that the basket forms an enclosure for receiving lint.

14. The lint storage system according to claim 10, further comprising:

a plurality of U-shaped ribs disposed along the U-shaped filter wall perpendicular to the longitudinal axis of the lint basket wherein the U-shaped ribs divide the U-shaped filter wall into a plurality of U-shaped sections; and a plurality of screened openings formed in the U-shaped sections wherein the surface area of the U-shaped section adjacent the second wall which is covered by screened openings is greater than the surface area of the U-shaped section adjacent the first wall which is covered by screened openings.

* * * * *